United States Patent [19]

Earner

[11] Patent Number: 4,962,923

[45] Date of Patent: Oct. 16, 1990

[54] PORTABLE SWIMMING APPARATUS

[76] Inventor: Margaret D. Earner, 4942 Mt. Etna Dr., San Diego, Calif. 92117

[21] Appl. No.: 341,960

[22] Filed: Apr. 24, 1989

[51] Int. Cl.[5] ..... A63B 31/00

[52] U.S. Cl. ..... 272/71; 272/900

[58] Field of Search ..... 272/71, 76, 900, 125, 272/136, 143; 220/1 R; 4/496

[56] References Cited

U.S. PATENT DOCUMENTS

| | | | |
|---|---|---|---|
| 1,890,699 | 12/1932 | Rosenhahn | 272/78 |
| 3,134,592 | 5/1964 | Sharkey | 272/900 |
| 3,512,416 | 5/1970 | Hohwart | 272/71 |
| 3,988,020 | 10/1976 | Carter | 272/71 |
| 4,095,657 | 6/1978 | Hohwart | 272/71 |
| 4,109,905 | 8/1978 | Meier | 272/71 |
| 4,247,096 | 1/1981 | Schmitt | 272/71 |
| 4,248,419 | 2/1981 | Hohwart | 272/71 |
| 4,486,016 | 12/1984 | Rubin | 272/78 |
| 4,524,711 | 6/1985 | Ashrow | 272/71 |

*Primary Examiner*—Stephen R. Crow

*Attorney, Agent, or Firm*—Andsel Group, Inc.

[57] ABSTRACT

A portable anchoring device for supporting swimmer harnesses while allowing the swimmer freedom of swimming movement. The anchoring device is a waterproof container with a closable top opening for filling the container with water or other material. The bottom of the container is covered with a material having a high coefficient of frictional resistance to prevent the container from slipping on a wet or dry surface. Removable rotatable flexible posts are mounted in threaded orifices on the container for securing the swimmers harness to the fixed container.

1 Claim, 1 Drawing Sheet

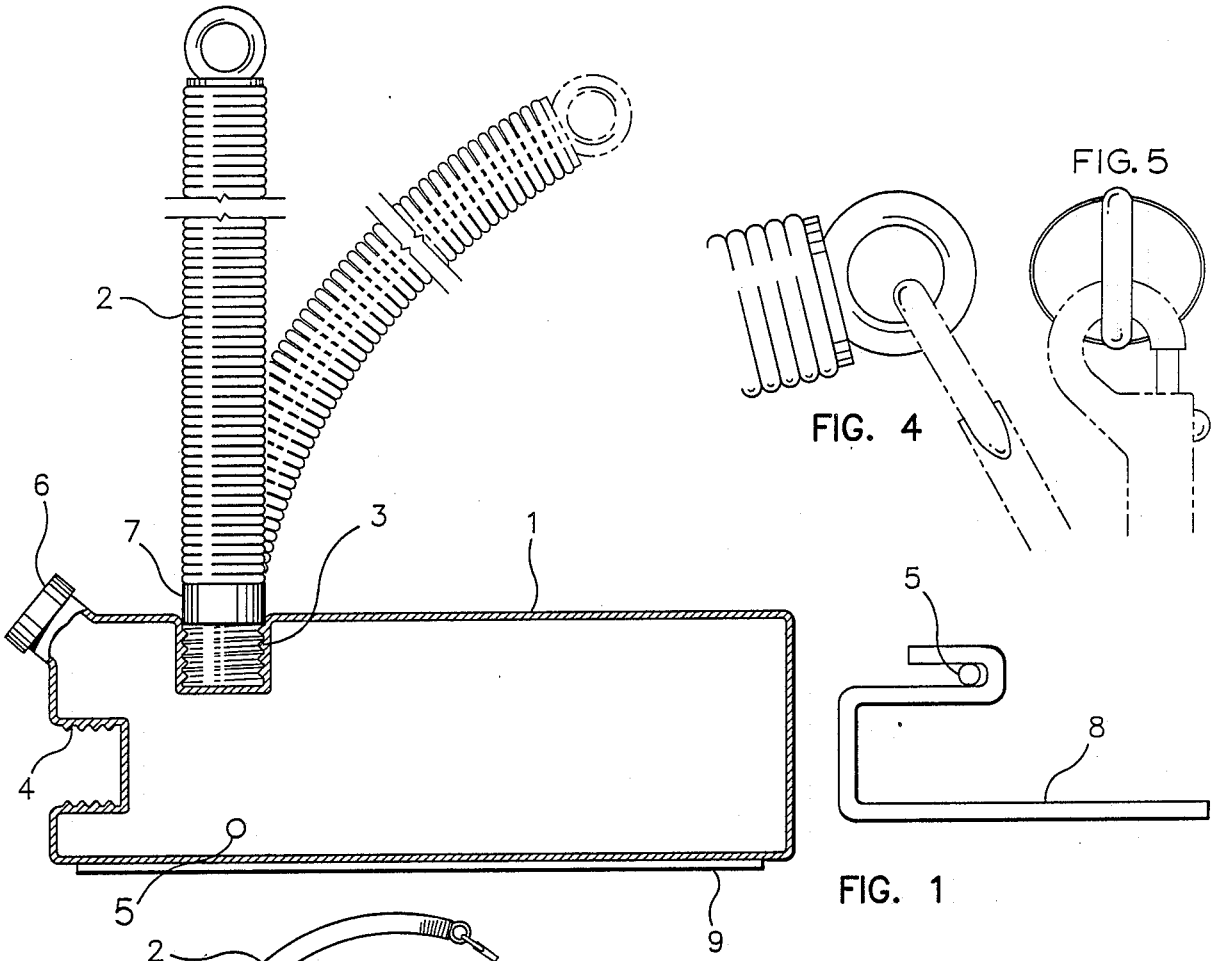
FIG. 4
FIG. 1
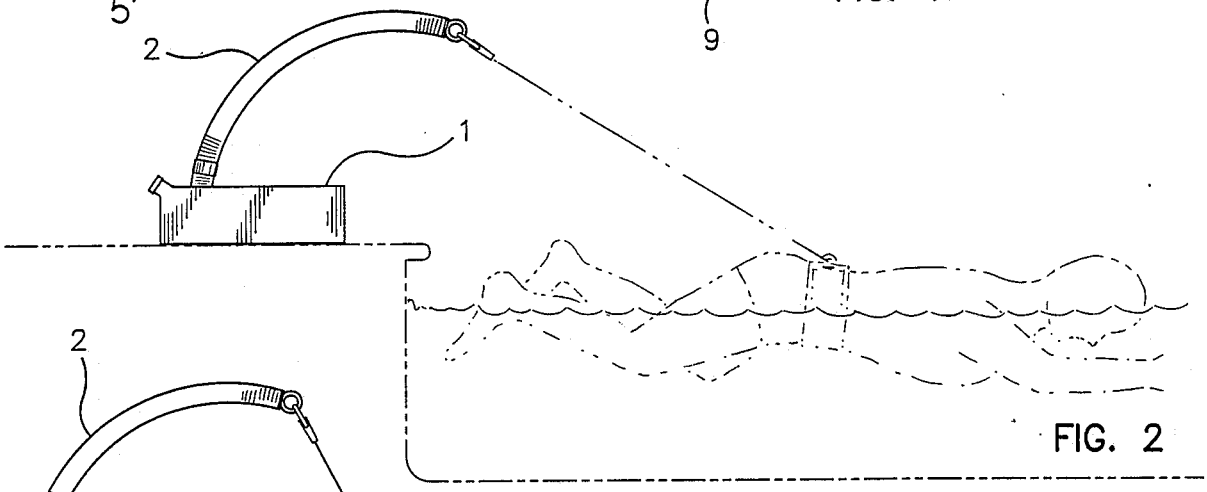
FIG. 2
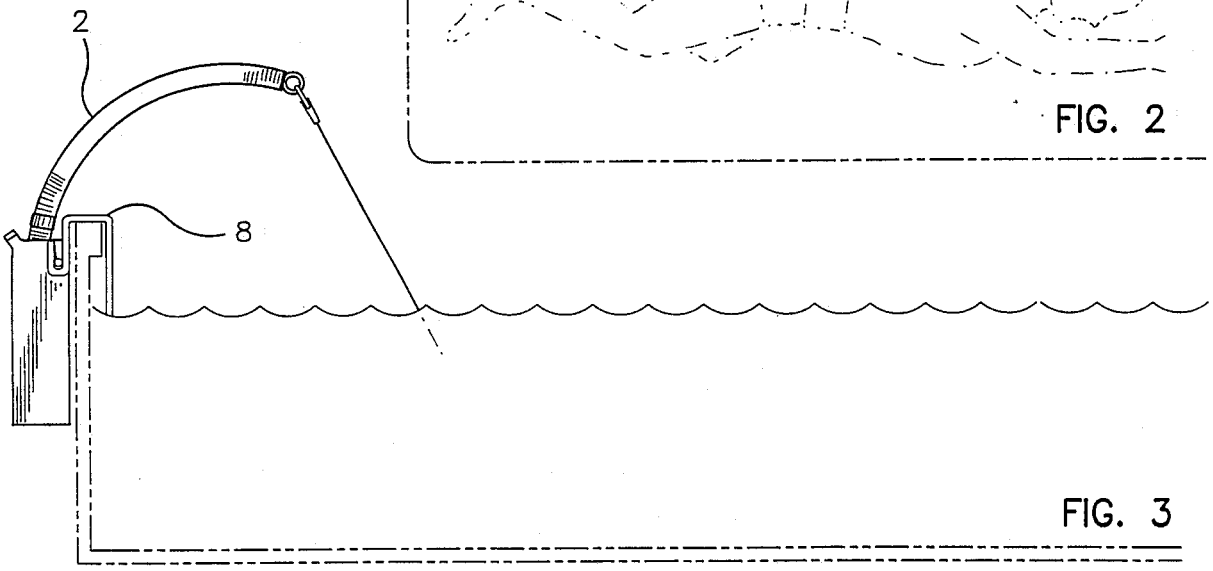
FIG. 3

PORTABLE SWIMMING APPARATUS

BACKGROUND OF THE INVENTION

1. Field of the Invention

The invention relates to swimmer training aids wherein a swimmer is restrained yet gives the swimmer freedom of swimming movement. A harness on the swimmer is flexibly attached to a portable weighted fixture on the edge of the swimming pool.

2. Description of the Prior Art

Several devices for restraining the swimmer to a localized area in the swimming pool are disclosed in the prior art. Examples of these devices are described in: U.S. Pat. Nos. 4,524,711 Ashrow; 4,248,419 Hohwart; 4,109,905 Meier; 4,247,096 Schmitt; 3,988,020 Carter; and 3,512,416. In all the devices described in the prior art the harness support is permanently anchored into the wall of the swimming pool.

SUMMARY OF THE INVENTION

The instant invention describes a portable anchoring device for the swimming apparatus. The anchoring device is a plastic, or metal, container filled with water or other ballast that can be temporarily placed anywhere along the pool side wall or on the surface surrounding the pool. A flexible upright member on the container is fastened at the top to the swimmer's harness. A friction surface on the bottom of the container prevents the container from sliding on any surface, wet or dry.

BRIEF DESCRIPTION OF THE DRAWINGS

FIG. 1 is a sectional side view of the portable swimming apparatus;

FIG. 2 shows the swimmer harnessed to the portable swimming apparatus;

FIG. 3 shows the container temporarily secured to the side wall of the swimming pool;

FIG. 4 is a detailed view of the harness connection to the portable swimming apparatus.

FIG. 5 is another detailed view of the harness connection to the portable swimming apparatus.

DETAILED DESCRIPTION OF THE PREFERRED EMBODIMENTS

The claimed improvement in portable swimming pool apparatuses is illustrated in FIG. 1 which shows a sectional view of the portable container 1 with the spring 4 flexible upright 2 threadably 3 attached to the top of container 1 by threaded receptacle 3. The upright 2 has rotatable around the bearing 7. An optional threaded receptacle 4 is shown on the end of the container 1, closable orifice 6 is located on the top of the container for filling the container with liquid ballast. An attaching pin 5 is provided for optionally attaching the container 1 by means of hook element 8, to the side wall of a swimming pool. The bottom surface 9 of the container has a high coefficient of frictional resistance.

In FIG. 2 the container is shown mounted on the surface surrounding the swimming pool. The flexible upright being loaded by the swimmers efforts. The attachment of the portable container to the side wall of a swimming pool is shown in FIG. 3. The detailed view of FIG. 4 illustrates the connection of the swimmer harness to the top and the flexible upright.

I claim:

1. A portable anchoring device for supporting a swimmer's harness wherein the improvement comprises;

(a), a waterproof container of plastic, filled with water for ballast;

(b), the container having a bottom surface having a high coefficient of frictional resistance;

(c), a first threaded orifice on the top surface of the container;

(d), a second threaded orifice on one end surface of the container;

(e), a closable opening on the top of the container for filling the container with water;

(f), a flexible, rotatable, post having a threaded end mountable in the threaded orifices on the container;

(g), the post terminating in a circular ring at the top for attaching a line to the swimmers harness;

(h), a pin projecting from the back of the container adjacent to the threaded orifices; and, (i), As a rod attachable to the pin for vertically attaching the container to the side wall of a swimming pool with the end threaded orifice at the top of the installed container.

* * * * *